United States Patent [19]

Persson

[11] 4,010,850

[45] Mar. 8, 1977

[54] DEVICE FOR SUSPENDING OBJECTS

[76] Inventor: Curt Hardy Persson, Brannerigatan 5, S-282 00 Tyringe, Sweden

[22] Filed: Nov. 14, 1975

[21] Appl. No.: 631,948

Related U.S. Application Data

[63] Continuation-in-part of Ser. No. 512,938, Oct. 7, 1974, abandoned.

[52] U.S. Cl. ..... 211/1.3; 211/94; 248/276

[51] Int. Cl.[2] ..... A47B 53/00

[58] Field of Search ..... 211/1.3, 94; 248/52, 248/276, 49, 51

[56] References Cited

UNITED STATES PATENTS

| | | | |
|---|---|---|---|
| 253,583 | 2/1882 | Clapp | 211/94 |
| 330,587 | 11/1885 | Hollweg | 248/276 |
| 1,132,190 | 3/1915 | Kohout | 211/94 |
| 1,587,675 | 6/1926 | Patterson | 211/1.3 |
| 3,716,986 | 2/1973 | Cork et al. | 248/52 |
| 3,801,174 | 4/1974 | Kanarr | 211/1.3 |

FOREIGN PATENTS OR APPLICATIONS

| | | | |
|---|---|---|---|
| 1,117,172 | 2/1956 | France | 248/49 |
| 1,273,952 | 7/1968 | Germany | 248/51 |

*Primary Examiner*—Robert A. Hafer
*Attorney, Agent, or Firm*—John J. Dennemeyer

[57] ABSTRACT

A device for suspending objects comprising a stationary stand with a straight inner passage which curves outwardly at one end. An elongate support member is received in the passage and consists of a series of vertebra-like elements fixed at one side to a flexible blade in a closely adjacent series arrangement to prevent bending of the support member in a downward direction. The vertebra elements have each a projecting flange on a side perpendicular to the flexible blade and a corresponding recess on the opposite side, the flange of one element engaging the recess of the adjacent element to prevent lateral displacement.

3 Claims, 3 Drawing Figures

DEVICE FOR SUSPENDING OBJECTS

This is a continuation-in-part application of Ser. No. 512,938 filed on Oct. 7, 1974 by Curt Hardy Persson entitled "Device for suspending objects", now abandoned.

The present invention relates to a device for suspending objects. In contrast to suspension arms of a predetermined length this device permits the suspension arm to be adjusted so that it has a small or a substantial length depending on the requirements. The device according to the invention also permits the suspension arm to be retracted and totally hidden.

The invention will be further described hereafter with reference to the accompanying drawing in which.

Figure 1:
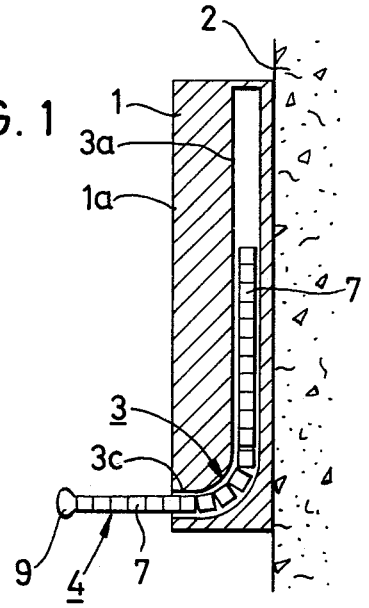
FIG. 1 illustrates the device according to the invention in a sectional view.
Figure 2:
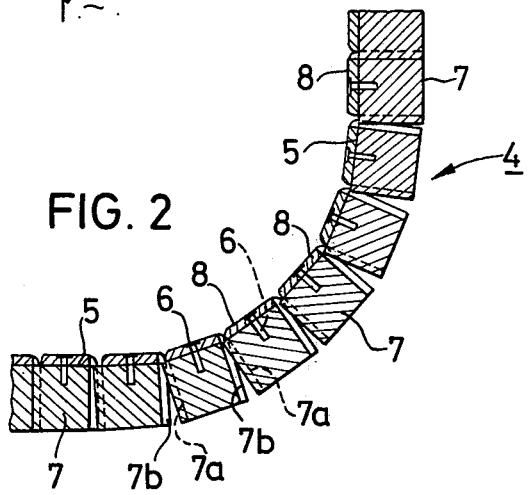
FIG. 2 illustrates a bent portion of the suspension arm of FIG. 1.
Figure 3:
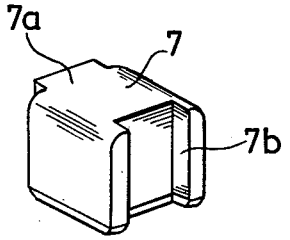
FIG. 3 is a perspective view of a link of the suspension arm.

The device shown in the drawing is generally intended for use in bath rooms to suspend towels, or on dressing tables to suspend necklaces, or in halls to suspend overcoats. The device is especially suited for spaces where an object is to be temporarily suspended and where permanently projecting suspension arms are undesirable.

In order to make this possible wherever there is a lack of space the device comprises an elongated stand portion 1 made from a suitable material, such as wood or a plastic material. The stand portion 1 is stationary and secured to the vertical wall 2, as shown in FIG. 1, so that the longitudinal axis thereof is disposed vertically, but when necessary it may be fixed to the wall 2 having the longitudinal axis thereof disposed horizontally. The stand portion 1 has an inner passage 3 which comprises a branch **3*a* directed longitudinally of the stand portion, a branch 3*b* directed towards and opening into one of the longer sides 1*a* of the stand portion, i.e. the front side of the stand portion, and a curved branch 3*c*, connecting the branch 3*a* to the branch 3*b*. The stand portion 1 is to hold a suspension arm generally designated by reference numeral 4**.

According to a typical embodiment the suspension arm 4 comprises a spring blade 5, whose length equals approximately the combined length of the branches **3*a*, 3*b*, and 3*c* of the passage. A series of vertebra-like members 7 are mounted on the spring blade 5 by means of rivets 6 or the like, so that the members engage one side of the spring blade. The other side of the spring blade may suitably be covered by thin plates 8, comprising edge portions cut from the vertebra members. The plates are held in a fixed position on the vertebra members by the rivets 6 and improve the stability of the suspension arm 4. The vertebra members 7 have cooperating grooves 7*b* and projections 7*a* in their adjacent surfaces. Each vertebra member has a projection on one of its sides engaging the groove of the preceding vertebra member and a groove in an opposite side for receiving a projection of the succeeding vertebra member. The grooves and projections extend along the entire height of the vertebra members such that there is continuous cooperative engagement along the entire height of the vertebra members in the straight extended portion of the suspension member and in the curved portion of the suspension member the grooves and projections of adjacent members are only in engagement in the region of the spring blade 5**. Due to the cooperative engagement of the grooves and projections along the entire height of the vertebra members in the straight extended portion of the suspension member the extended portion is very stable and resistant against lateral forces.

The components of the suspension arm 4 are so dimensioned that they permit pushing or sliding thereof into the passage 3. The embodiment of the components of the arm disclosed above permits the spring blade 5 to yield when it passes the curved portion **3*c* of the passage, which means that the arm 4 may be pushed into the passage and thus may be totally hidden in the stand portion, eventually excluding an end piece 9. Thereafter the arm may be pulled outwardly more or less, as desired, and the portion projecting from the stand portion does not bend inwardly or sideways when objects are hung thereon. Thus the vertebra members will engage each other and prevent a bending of the spring blade in a downward direction, and a sideways bending of the arm is prevented by the flange parts 7*a* gripping into each recess 7*b*, respectively. Furthermore, a bending of the arm sideways is prevented by the spring blade itself. In contrast thereto, the arm 4** may yield when pushed from below and thereby the risk for damage is eliminated, which exists when using non-yieldable projection components.

The device described above presents an especially advantageous embodiment, but the invention is not to be limited to this embodiment, and may be varied within the scope of the following claims. As an example of alternative embodiments a stand portion may be mentioned having several passages and arms, one arm being provided with another supporting means besides a spring blade, and a stand portion comprising a plate engaging a substrate, and a member projecting therefrom with a passage 3. In the latter alternative a couple of fixed suspension arms may be provided on the plate, and the arms may not project further than the projecting member with the passage 3. The suspension arm may further be provided with a stop heel engaging an abutment in the stand portion and preventing the arm from being pulled too far out of the passage.

All the parts of the device may be made from wooden, plastic or metal material and optionally an outer layer of a felt-like material may be provided on the stand portion.

What is claimed is:

1. A device for suspending objects, comprising:

a body having at least one inner passage provided with a portion directed longitudinally of the body, a portion directed laterally toward and opening into one of the long sides of said body, and a curved intermediate portion; and a suspension arm normally disposed in said inner passage and movable into and out of said passage, said suspension arm comprising:

a. an elongated, flexible, continuous spring blade presenting an unbroken upper surface and adapted to be bent upwardly when said arm passes said curved intermediate portion in case of a displacement of said arm in said passage; and b. a plurality of vertebra-like members attached to said spring blade and arranged in side-to-side abutting relationship to prevent downward bending of said spring blade beyond a condition wherein said blade is straight, each of said members having on one side a projection and on an opposite side a recess, said projections and said recesses on adjacent members being arranged to interengage when said members are brought into abutting relationship and extending along the entire height of said members, the top face of said vertebra-like members being fixed to the undersurface of said spring blade, whereby said spring blade can be bent in the upward direction for moving the arm through said curved portion of said body, but said abutting vertebra-like members prevent bending of said spring blade downwardly from said straight condition, and said interengaged projections and recesses prevent bending of said spring blade in all other directions except upwardly when said spring blade is in said straight condition, so that the portion of said spring blade pulled from the passage presents an unbroken upper surface and maintains a straight shape without yielding when objects are suspended therefrom.

2. A device according to claim 1, wherein the vertebra-like members are so shaped and placed in relation to each other that said projections engage at least some part of their associated recesses at all times.

3. A device according to claim 1, wherein the stand portion is fixed to a stationary support so that the longitudinal passage branch is vertically directed and the passage branch is positioned below so that a pulled out portion of the suspension arm yields when loaded from below.

* * * * *